US007018952B2

(12) United States Patent
Tsukida et al.

(10) Patent No.: US 7,018,952 B2
(45) Date of Patent: Mar. 28, 2006

(54) METHOD FOR RECORDING AND ERASURE OF IMAGES USING A REWRITABLE THERMAL LABEL OF A NON-CONTACT TYPE

(75) Inventors: Tatsuya Tsukida, Yoshikawa (JP); Tetsuyuki Utagawa, Kawaguchi (JP); Satoshi Kawada, Setagaya (JP)

(73) Assignee: Lintec Corporation, Tokyo (JP)

( * ) Notice: Subject to any disclaimer, the term of this patent is extended or adjusted under 35 U.S.C. 154(b) by 260 days.

(21) Appl. No.: 10/723,854

(22) Filed: Nov. 26, 2003

(65) Prior Publication Data

US 2004/0116289 A1 Jun. 17, 2004

(30) Foreign Application Priority Data

Dec. 17, 2002 (JP) ..... 2002-365581

(51) Int. Cl.
*B41M 5/20* (2006.01)

(52) U.S. Cl. ..... 503/201; 430/945; 503/200; 503/216; 503/226

(58) Field of Classification Search ..... 430/945; 503/200, 201, 216, 226
See application file for complete search history.

(56) References Cited

FOREIGN PATENT DOCUMENTS

| | | |
|---|---|---|
| CA | 2 446 827 A | 11/2002 |
| JP | 3295746 B2 | 4/2002 |

*Primary Examiner*—Bruce H. Hess
(74) *Attorney, Agent, or Firm*—Frishauf, Holtz, Goodman & Chick, P.C.

(57) ABSTRACT

A method for recording and erasure of images using a rewritable thermal label of the non-contact type which enables complete elimination of residual images after the erasure and repeated rewriting. The absorptivity of laser light used for the recording with the surface of the label is 50% or greater, the laser light irradiating the surface of the label for the recording has a wavelength of 700 to 1,500 nm and an amount of energy of irradiation of 5.0 to 15.0 mJ/mm$^2$, the product of the amount of energy of irradiation of the laser light and the absorptivity of the laser light during the recording is 3.0 to 14.0 mJ/mm$^2$, and the product of the amount of energy of irradiation of the laser light and the absorptivity of the laser light with the surface of the label during the erasure is 1.1 to 3.0 times as great as the corresponding product during the recording.

12 Claims, 1 Drawing Sheet

METHOD FOR RECORDING AND ERASURE OF IMAGES USING A REWRITABLE THERMAL LABEL OF A NON-CONTACT TYPE

BACKGROUND OF THE INVENTION

1. Field of the Invention

The present invention relates to a rewritable thermal label of the non-contact type. More particularly, the present invention relates to a method for recording and erasure of images using a rewritable thermal label of the non-contact type which enables rewriting images repeatedly in accordance with the non-contact method.

2. Description of Related Art

Currently, labels for control of articles such as labels attached to plastic containers used for transporting foods, labels used for control of electronic parts and labels attached to cardboard boxes for control of distribution of articles are mainly labels having a heat-sensitive recording material such as direct thermal paper as the face substrate. In the heat-sensitive recording material, a heat-sensitive recording layer containing an electron-donating dye precursor which is, in general, colorless or colored slightly and an electron-accepting color developing agent as the main components is formed on a support. When the heat-sensitive recording material is heated by a heated head or a heated pen, the dye precursor and the color developing agent react instantaneously with each other and a recording image is obtained. When an image is formed on the heat-sensitive recording material, in general, it is impossible that the formed image is erased and the condition is returned to that before the image is formed. However, the use of a rewritable label in which the heat-sensitive recording material allows erasure of images and rewriting of other images is recently increasing. When the label attached to an adherend is treated by rewriting without detaching the label from the adherend, the label attached to the adherend cannot be treated by passing through an ordinary printer for erasure of the recorded images and rewriting of other images. For this purpose, it is necessary that the erasure and the writing be performed in accordance with a method performed without contact.

Due to the above circumstances, in recent years, reversible heat-sensitive recording materials which allow recording and erasure of images for repeated use of a label, such as (1) a reversible heat-sensitive recording material having a heat-sensitive layer which is formed on a substrate and contains a resin and an organic low molecular weight substance showing reversible changes in transparency depending on the temperature and (2) a reversible heat-sensitive recording material having a heat-sensitive color development layer which is formed on a substrate and contains a dye precursor and a reversible color developing agent, have been developed. However, in the conventional rewritable thermal labels of the non-contact type, the erased image slightly remains without being completely erased during the repeated use. Due to the accumulation of the residual images, the contrast between the portion having recorded images and the portion having no recorded images decreases and problems arise on the visibility of characters and the readability of bar codes.

Patent reference 1: Japanese Patent No. 3295746

SUMMARY OF THE INVENTION

The present invention has an object of providing a method for recording and erasure of images using a rewritable thermal label of the non-contact type which enables substantially complete elimination of residual images after the erasure and repeated rewriting.

As the result of intensive studies by the present inventors, it was found that, for clear recording of images using a rewritable thermal label of the non-contact type and substantially complete elimination of residual images after erasure, it was necessary that laser light having a specific wavelength and a specific amount of energy was used for the recording and a light having a specific amount of energy which is decided in accordance with the amount of energy used for the recording was used for the erasure. The present invention has been completed based on this knowledge.

The present invention provides:

(1) A method for recording and erasure of images using rewritable thermal label of a non-contact type which comprises a heat-sensitive color development layer comprising a leuco dye and a long chain alkyl-based color developing agent and a light absorption and photo-thermal conversion layer which are laminated on one face of a substrate successively, the heat-sensitive color development layer being placed next to the substrate, and an adhesive layer laminated on an other face of the substrate, wherein an absorptivity of laser light used for the recording with a surface of the label is 50% or greater, the laser light irradiating the surface of the label for the recording has a wavelength in a range of 700 to 1,500 nm and an amount of energy of irradiation in a range of 5.0 to 15.0 $mJ/mm^2$, a product of the amount of energy of irradiation of the laser light and the absorptivity of the laser light during the recording is in a range of 3.0 to 14.0 $mJ/mm^2$, and a product of an amount of energy of irradiation of the laser light and an absorptivity of the laser light with the surface of the label during the erasure is 1.1 to 3.0 times as great as the product of the amount of energy of irradiation of the laser light and the absorptivity of the laser light during the recording;

(2) A method according to (1), wherein, during the erasure of images, the surface of the label is heated within 4 seconds after irradiation with the laser light for the erasure is started;

(3) A method according to any one of (1) and (2), wherein the absorptivity of light with the surface of the label is in a range of 50 to 90% and the method is used for recording images into labels in which the recorded images are read using reflected light;

(4) A method for recording and erasure of images using rewritable thermal label of a non-contact type which comprises a heat-sensitive color development layer comprising a leuco dye and a long chain alkyl-based color developing agent and a light absorptivity and photo-thermal conversion layer which are laminated on one face of a substrate successively, the heat-sensitive color development layer being placed next to the substrate, and an adhesive layer laminated on an other face of the substrate, wherein an absorptivity of laser light used for the recording with a surface of the label is 50% or greater, the laser light irradiating the surface of the label for the recording has a wavelength in a range of 700 to 1,500 nm and an amount of energy of irradiation in a range of 5.0 to 15.0 $mJ/mm^2$, a product of the amount of energy of irradiation of the laser light and the absorptivity of the laser light during the recording is in a range of 3.0 to 14.0 $mJ/mm^2$, a light irradiating the surface of the label for the erasure is ultraviolet light or near infrared light, and a product of an amount of energy of irradiation of the ultraviolet light or the near infrared light and an absorptivity of the ultraviolet light or the near infrared light with the surface of the label during the erasure is 1.1 to 3.0 times as great as the product of the amount of energy of irradiation of the laser light and the absorptivity of the laser light during the recording;

(5) A method according to (4), wherein the light irradiating the surface of the label for the erasure is ultraviolet light having a wavelength in a range of 200 to 400 nm or near infrared light having a wavelength in a range of 700 to 1,500 nm;

(6) A method according to any one of (4) and (5), wherein, during the erasure of images, the surface of the label is heated within 4 seconds after irradiation with the ultraviolet light or the near infrared light for the erasure is started; and (7) A method according to any one of (4), (5) and (6), wherein the absorptivity of light with the surface of the label is in a range of 50 to 90% and the method is used for recording images into labels in which the recorded images are read using reflected light.

Figure 1:
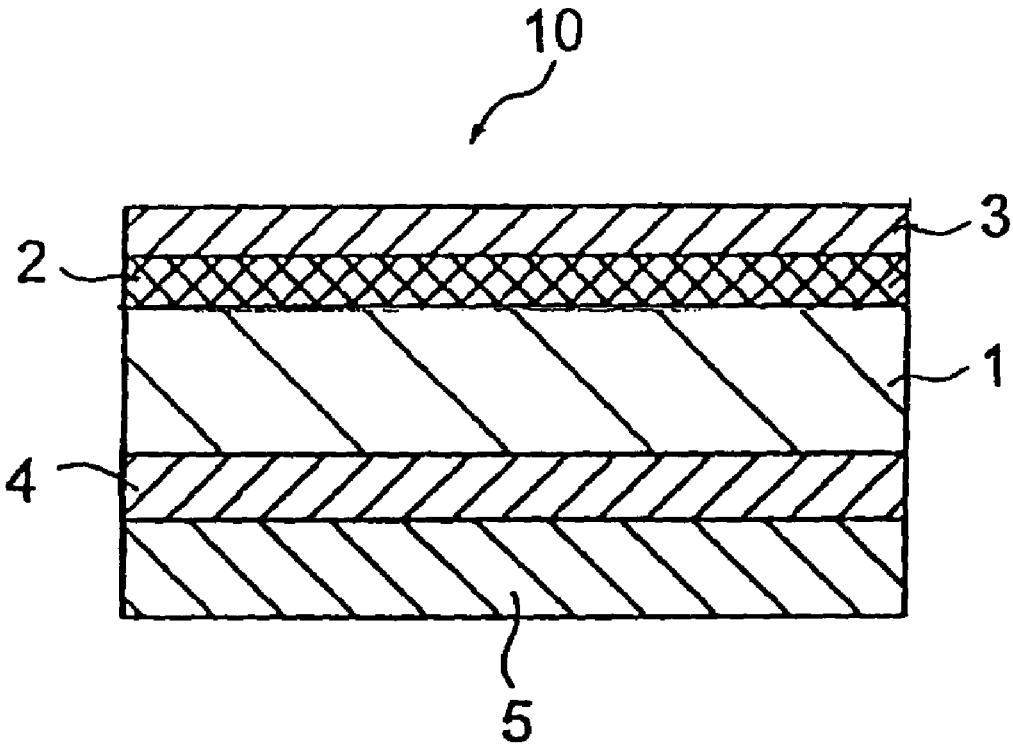
FIG. 1 shows a sectional view exhibiting an embodiment of the rewritable thermal label of the non-contact type used in the present invention.

The numbers in the FIGURE have the meanings as listed in the following:

1: A substrate

2: A heat-sensitive color development layer

3: A light absorption and photo-thermal conversion layer

4: An adhesive layer

5: A release sheet

10: A rewritable thermal label of the non-contact type

DESCRIPTION OF THE PREFERRED EMBODIMENTS

The method for recording and erasure of images using a rewritable thermal label of the non-contact type of the present invention comprises the first embodiment using laser light for both of the recording and the erasure and the second embodiment using laser light for the recording and ultraviolet light or near infrared light for the erasure.

The first embodiment of the present invention will be described in the following.

The rewritable thermal label of the non-contact type used in the present invention is a label which allows rewriting images in a manner such that the color of a reversible heat-sensitive color development layer is formed or erased by heat generated in a light absorption and photo-thermal conversion layer due to an optical stimulation and the images are recorded (written or marked) and erased repeatedly without contacting the label.

The rewritable thermal label of the non-contact type used in the present invention will be described more specifically with reference to a FIGURE in the following. The FIGURE exhibits an embodiment of the rewritable thermal label of the non-contact type used in the present invention. However, the rewritable thermal label of the non-contact type used in the present invention is not limited to that shown in the FIGURE.

FIG. 1 shows a sectional view exhibiting an embodiment of the rewritable thermal label of the non-contact type used in the present invention.

In FIG. 1, the rewritable thermal label of the non-contact type 10 has a heat-sensitive color development layer 2 and a light absorption and photo-thermal conversion layer 3 which are successively laminated to one face of a substrate 1 and a release sheet 5 temporarily attached to the other face of the substrate 1 via an adhesive layer 4.

As the substrate 1, any substrate can be used without any restrictions as long as the substrate can be used as the substrate of a conventional rewritable thermal label of the non-contact type. Examples of the substrate include plastic films such as films of polystyrene, ABS resins, polycarbonate, polypropylene, polyethylene and polyethylene terephthalate; synthetic papers; non-woven fabrics; and papers. For the substrate, the same material as that for the adherend is preferable so that the substrate can be recycled together with the adherend. The thickness of the substrate 1 is, in general, in the range of 10 to 500 μm and preferably in the range of 20 to 200 μm.

When a plastic film is used as the substrate 1, where desired, a surface treatment such as an oxidation treatment and a roughening treatment may be conducted to improve adhesion with the coating layer formed on the surfaces. Examples of the oxidation treatment include the treatment with corona discharge, the treatment with chromic acid (a wet process), the treatment with flame, the treatment with the heated air and the treatment with ozone in combination with irradiation with ultraviolet light. Examples of the roughening treatment include the treatment by sand blasting and the treatment with a solvent. The surface treatment can be suitably selected in accordance with the type of the substrate. In general, the treatment with corona discharge is preferable from the standpoint of the effect and operability.

To effectively utilize the heat converted during the recording of images with laser light, it is effective that a foamed plastic film having a great heat insulating effect is used as the substrate 1. Although a plastic film is preferable as the substrate, a paper substrate may also be used advantageously when the number of the repeated use is not great.

The heat-sensitive color development layer 2 comprising a leuco dye and a long chain alkyl-based color developing agent can be formed on the substrate 1.

In general, the heat-sensitive color development layer used for the rewritable thermal label comprises a colorless or slightly colored dye precursor and a reversible color developing agent and, where necessary, may further comprise color erasure accelerators, binders, inorganic pigments and various additives.

The heat-sensitive color development layer comprising a leuco dye and a long chain alkyl-based color developing agent is not particularly limited as long as the object of the present invention can be achieved. Suitable compounds can be selected from leuco dyes and long chain alkyl-based color developing agents which are conventionally used for heat-sensitive recording materials.

As the leuco dye, for example, a triarylmethane compound can be used singly or compounds selected from xanthene-based compounds, diphenylmethane-based compounds, spiro-based compounds and thiazine-based compounds can be used singly or in combination of two or more. Specifically, compounds selected from triarylmethane-based compounds such as 3,3-bis(4-dimethyaminophenyl)-6-dimethylamino-phthalide, 3-(4-dimethylaminphenyl)-3-(1,2-dimethylindol-3-yl)phthalide and 3-(4-diethylamino-2-ethoxyphenyl)-3-(1-ethyl-2-methylindol-3-yl)-4-azaphthalide; xanthene-based compounds such as rhodamine B anilinolactum and 3-(N-ethyl-N-tolyl)amino-6-methyl-7-anilino-fluoranthene; diphenylmethane-based compounds such as 4,4'-bis-(dimethylaminophenyl)benzhydryl benzyl ether and N-chlorophenyl-leucoauramine; spiro-based compounds such as 3-methylspiro-dinaphthopyran and 3-ethylspirodinaphthopyran; and thiazine-based compounds such as benzoylleucomethylene blue and p-nitrobenzoyl-leucomethylene blue, can be used singly or in combination of two or more.

Among the above compounds, 3-(4-diethylamino-2-ethoxyphenyl)-3-(1-ethyl-2-methylindol-3-yl)-4-azaphthalide which is a triarylmethane-based compound is preferable.

The long chain alkyl-based color developing agent used in the heat-sensitive color development layer is a compound having long chain alkyl groups as the side chains such as phenol derivatives, hydrazine compounds, anilide compounds and urea compounds having long chain alkyl groups as the side chains. Compounds which reversibly change the color tone of the leuco dye depending on the difference in the rate of cooling after being heated can be used without restrictions. From the standpoint of the crystallinity, the concentration of the developed color, the property for erasing color and the durability in the repeated color development and erasure, electron accepting compounds which are phenol derivatives having long chain alkyl groups can be used.

The above phenol derivative may have atoms such as oxygen and sulfur and the amide linkage in the molecule. The length and the number of the alkyl group are decided taking the balance between the property for erasing color and the property for color development into consideration. It is preferable that the long chain alkyl group in the side chain has 8 or more carbon atoms and more preferably 10 to 24 carbon atoms.

Examples of the phenol derivative having long chain alkyl groups include 4-(N-methyl-N-octadecylsulfonylamino) phenol, N-(4-hydroxyphenyl)-N'-n-octadecylthiourea, N-(4-hydroxyphenyl)-N'-octadecylurea, N-(4-hydroxyphenyl)-N'-n-octadecylthioamide, N-[3-(4-hydroxyphenyl)-propiono]-N'-octadecanohydrazide and 4'-hydroxy-4-octadecylbenzanilide.

As the phenol derivative having along chain alkyl groups used as the reversible color developing agent which is a component forming the heat sensitive color development layer, 4-(N-methyl-N-octadecylsulfonylamino)phenol is preferable.

For forming the heat-sensitive color development layer 2, a coating liquid can be prepared by dissolving or dispersing the leuco dye, the long chain alkyl-based color developing agent and various additives which are used where desired into an organic solvent suitable for the application. As the organic solvent, organic solvents based on alcohols, ethers, esters, aliphatic hydrocarbons and aromatic hydrocarbons can be used. Tetrahydrofuran (THF) is preferable due to the excellent property for dispersion. The relative amounts of the leuco dye and the long chain alkyl-based color developing agent are not particularly limited. The long chain alkyl-based color developing agent can be used in an amount in the range of 50 to 700 parts by weight and preferably in the range of 100 to 500 parts by weight per 100 parts by weight of the leuco dye.

As the binder which is used where necessary for holding the components constituting the heat-sensitive color development layer and maintaining the uniform distribution of the components, for example, polymers such as polyacrylic acid, polyacrylic esters, polyacrylamide, polyvinyl acetate, polyurethanes, polyesters, polyvinyl chloride, polyethylene, polyvinyl acetal and polyvinyl alcohol and copolymers derived from these polymers are used. The binder can also be used for improving dispersion.

As for the components used where necessary, examples of the color erasure accelerator include ammonium salts; examples of the inorganic pigment include talc, kaolin, silica, titanium oxide, zinc oxide, magnesium carbonate and aluminum hydroxide; and examples of the other additive include leveling agents and dispersants which are conventionally used.

The coating fluid prepared as described above is applied to the substrate in accordance with a conventional process. The formed coating layer is treated by drying and the heat-sensitive color development layer is formed. The temperature of the drying treatment is not particularly limited. It is preferable that the drying treatment is conducted at a low temperature to prevent color development of the dye precursor. The thickness of the heat sensitive color development layer 2 formed as described above can be adjusted in the range of 1 to 10 μm and preferably in the range of 2 to 7 μm.

The light absorption and photo-thermal conversion layer 3 has the function of absorbing the incident near infrared laser light, ultraviolet light or near infrared light and converting the absorbed light into heat. It is preferable that light in the visible region is not absorbed much. When light in the visible region is absorbed, the visibility and the readability of bar code deteriorate. The light absorption and photo-thermal conversion layer having the above property can be formed with a material suitably selected from conventional materials for forming light absorption and photo-thermal conversion layers for rewritable thermal labels and comprises the light-absorbing agent and a binder and may also comprise inorganic filler, lubricants, antistatic agents and other additives which are used where necessary. At least one material selected from organic dyes and/or organometallic coloring matters which are light-absorbing agents such as cyanine-based coloring matters, phthalocyanine-based coloring matters, anthraquinone-based coloring matters, azulene-based coloring matters, squalerium-based coloring matters, metal complex-based coloring matters, triphenylmethane-based coloring matters and indolenin-based coloring matters, can be used as the light-absorbing agent of the light absorption and photo-thermal conversion layer of the present invention. Among these compounds, the metal complex-based coloring matters and the indolenin-based coloring matters are preferable due to the excellent ability of converting light into heat.

As the binder in the light absorption and photo-thermal conversion layer 3, the binders described above as the examples of the binder in the color development layer 2 can be used. Since the light absorption and photo-thermal conversion layer 3 constitutes the outermost layer of the label, the transparency for visualizing the color formed in lower layers and the hard coat property (the scratch resistance) of the surface are required. Therefore, resins of the crosslinking type are preferable and resins curable with ionizing radiation such as ultraviolet light and electron beams are more preferable as the binder. For forming the light absorption and photo-thermal conversion layer 3, first a coating fluid comprising the light-absorbing agent described above, the binder and other additives which are used where necessary is prepared. In the preparation, where necessary, a suitable organic solvent may be used depending on the type of the binder. The relative amounts of the binder and the light-absorbing agent are not particularly limited. The light-absorbing agent can be used in an amount in the range of 0.1 to 50 parts by weight and preferably in the range of 0.5 to 10 parts by weight per 100 parts by weight of the binder. When the amount of the light-absorbing agent exceeds the above range, there is the possibility that the surface is colored since the light-absorbing agent occasionally absorbs light in the visible region. When the surface is colored, not only the appearance of the label but also the visibility of the images and the readability of bar codes deteriorate. Therefore, it is preferable that the amount of the light-absorbing agent is suppressed to the minimum value taking the balance with the sensitivity of the color formation by heat generation into consideration.

The coating fluid prepared as described above is applied to the surface of the heat-sensitive color development layer 2 described above in accordance with a conventional process. After the formed coating layer is treated by drying, the coating layer is crosslinked by heating or by irradiation with an ionizing radiation and the light absorption and photo-thermal conversion layer 3 is formed. The thickness of the light absorption and photo-thermal conversion layer 3 formed as described above is, in general, in the range of 0.05 to 10 μm and preferably in the range of 0.1 to 3 μm.

An anchor coat layer may be formed on one face of the substrate 1 described above, where necessary. The anchor coat layer is formed to protect the substrate from the solvent in the coating fluid used for forming the heat-sensitive color development layer 2 in the following step. The use of a substrate having poor resistance to solvents is made possible by the formation of the anchor coat layer. When a material having poor resistance to solvents is used as the substrate, it is preferable that a coating fluid of an aqueous solution or an aqueous dispersion is used for forming the anchor coat layer. Examples of the resin used for the fluid of an aqueous coating solution include starch, polyvinyl alcohol (PVA) resins and cellulose resins. Examples of the resin used for the coating fluid of an aqueous dispersion include acrylic resins, polyester resins, polyurethane resins and ethylene-vinyl acetate copolymer resins. Crosslinked resins derived from these resins are preferable from the standpoint of the solvent resistance.

Resins of the non-solvent type which are curable by crosslinking with ionizing radiation such as ultraviolet light and electron beams can be effectively used. When the resin curable with ionizing radiation is used, the degree of crosslinking can be easily adjusted by changing the amount of irradiation and, moreover, a crosslinked resin having a great crosslinking density can be formed.

It is sufficient that the anchor coat layer has a thickness in the range of 0.1 to 30 μm. When a substrate having poor solvent resistance is used as the substrate 1, the anchor coat layer having a greater thickness is more effective for protecting the substrate from the solvent-based coating fluid used in the following step since the barrier property is enhanced and the solvent resistance is improved. When the thickness is smaller than 0.1 mm, the substrate cannot be protected from the solvent. When the thickness exceeds 30 μm, the effect is not much enhanced by the increase of the thickness.

It is preferable that the crosslinked resin forming the anchor coat layer has a degree of crosslinking such that the gel fraction is 30% or greater and more preferably 40% or greater. When the gel fraction is smaller than 30%, the solvent resistance is insufficient and there is the possibility that the substrate 1 is not sufficiently protected from the solvent in the coating fluid during the formation of the heat-sensitive color development layer 2 in the following step.

It is necessary that the absorptivity of laser light used for the recording with the surface of the rewritable thermal label of the non-contact type used in the present invention is 50% or greater. When the absorptivity is smaller than 50%, the energy provided by the irradiation to the surface of the label and used for the recording is insufficient. Therefore, the image cannot be clearly recorded during the recording and the image cannot be completely erased during the erasure.

When the method of the present invention is used for recording images into a label in which the recorded images are read using reflected light such as a label in which the images are read as combinations of line charts, examples of which include a bar code label, a calra code label and an OCR label, it is necessary that the absorptivity of near infrared laser light with the surface of the label be in the range of 50 to 90%. When the absorptivity exceeds 90%, the difference in the reflected light at the linear FIGURE portion and at portions not used for the recording becomes indistinguishable in the reading using reflected light in the critical wavelength region and the function of the bar code and the like is lost.

The absorptivity of light can be adjusted by changing the amount of the light absorbing agent in the light absorption and photo-thermal conversion layer used in the method of the present invention.

The absorptivity of light can be obtained by measuring the reflectivity of the light incident on the surface of the rewritable thermal label of the non-contact type used in the present invention using a spectrometer, followed by calculating the absorptivity as (100-reflectivity) %.

The adhesive layer 4 is disposed on the face of the substrate 1 opposite to the face having the layers described above. It is preferable that the adhesive constituting the adhesive layer 4 has a composition of resins which exhibits excellent adhesion to an adherend comprising plastics and does not adversely affect recycling when the label is recycled together with the adherend. Adhesives comprising acrylic ester-based copolymers as the resin component are preferable due to the excellent property for recycling. Rubber-based adhesives, polyester-based adhesive and polyurethane-based adhesives can also be used. Silicone-based adhesive exhibiting excellent heat resistance can be used. However, the silicone-based adhesives occasionally causes a decrease in strength and deterioration in appearance since the recycled resins tend to become heterogeneous due to poor compatibility with the adherend in the recycling step.

As the adhesive, any of adhesives of the emulsion type, adhesives of the solution type and adhesive of the non-solvent type can be used. Adhesives of the crosslinking type are preferable since water resistance in the cleaning step which is conducted for repeated use of the adherend is excellent and durability in holding the rewritable thermal label is improved. The thickness of the adhesive layer 4 is, in general, in the range of 5 to 60 μm and preferably in the range of 15 to 40 μm.

The adhesive layer 4 may be formed by directly applying the adhesive to the surface of the substrate 1 in accordance with a conventional process such as the process using a knife coater, a reverse coater, a die coater, a gravure coater or a Mayer bar, followed by drying the formed coating layer. As another process, the adhesive layer 4 may be formed on the releasing face of a release sheet 5 by applying the adhesive in accordance with the above process, followed by drying the formed coating layer 4 and then the formed adhesive layer may be transferred to the substrate 1 by attaching the laminate thus formed to the substrate 1. The transfer process is preferable since the efficiency of drying the adhesive can be increased without causing development of color in the heat-sensitive color development layer 2 disposed on the substrate. A material sheet of the rewritable thermal label of the non-contact type can be prepared in accordance with a process in which the adhesive layer is formed by applying the adhesive on the release sheet, followed by drying the formed coating layer, the obtained laminate of the adhesive layer and the release sheet is attached to the substrate used as the face sheet, and the obtained material sheet is wound. The release sheet 5 may be left being attached to the adhesive layer 4, where necessary. As the release sheet 5, plastic films such as polyethylene terephthalate (PET) films, foamed PET films and polypropylene films, paper laminated with polyethylene, glassine paper, glassine paper laminated with polyethylene and clay coat paper which are coated with a releasing agent can be used. As the releasing agent, silicone-based releasing agents are preferable. Fluorine-based releasing agents, and releasing agents based on carbamates having a long chain alkyl group can also be used. The thickness of the coating layer of the releasing agent is, in general, in the range of 0.1 to 2.0 μm and preferably in the range of 0.5 to 1.5 μm. The thickness of the release sheet 5 is not particularly limited. The thickness of the release sheet is, in general, about 20 to 150 μm.

As for the process for preparation and working of the rewritable thermal label used in the method of the present invention, it is preferable that the layers are formed in a manner such that the heat-sensitive color development layer 2 and the light absorption and photo-thermal conversion layer 3 are formed on one face of the substrate 1 in this order and, then, the release sheet 5 having the adhesive layer 4 is attached to the other face of the substrate. Where necessary, the anchor coat layer is formed on one face of the substrate 1 and, then, the heat-sensitive color development layer 2 and the light absorption and photo-thermal conversion layer 3 are formed on the formed anchor coat layer in this order.

The anchor coat layer, the heat-sensitive color development layer and the light absorption and photo-thermal conversion layer can be formed by applying the respective coating fluids in accordance with a coating process such as the direct gravure coating process, the gravure reverse coating process, the microgravure coating process, the coating process using a Mayer bar, an air knife, a blade, a die or a roll knife, the reverse coating process and the curtain coating process, and a printing process such as the flexo printing process, the letter press printing process and the screen printing process, drying the formed coating layer and, where necessary, heating the dried coating layer. In particular, it is preferable that the heat-sensitive color development layer is dried at a low temperature so that the color is not developed. When the layer of the ionizing radiation curing type is used, the layer can be cured by irradiation with ultraviolet light or electron beams.

The material sheet 10 of the rewritable thermal label of the non-contact type can be formed into the shape of the label by die cutting the sheet into the prescribed size of the label using a label printer or the like.

As for the method for recording (printing) in the method of the present invention, the desired information is recorded (printed) on the rewritable thermal label before the rewritable thermal label is attached to the adherend. For this recording, any of the contact method in which a thermal head is brought into contact with the light absorption and photo-thermal conversion layer and the non-contact method using laser light may be used. The non-contact method is preferable and the method for recording in accordance with the non-contact method will be described.

In accordance with the non-contact method, laser light irradiates the surface of the rewritable thermal label in the non-contacting condition and the light absorbing agent in the light absorption and photo-thermal conversion layer 3 at the surface of the rewritable thermal label absorbs the laser light and converts the absorbed laser light into heat. Due to the heat generated by the conversion, the dye precursor and the reversible color developing agent in the heat-sensitive color development layer 2 below the light absorption and photo-thermal conversion layer 3 react with each other. Thus, the dye precursor develops the color and the recording is achieved.

It is necessary that, as the laser light used for the recording in the method of the present invention, near infrared laser light having a wavelength in the range of 700 to 1,500 nm be used for the irradiation. Laser light having the wavelength shorter than 700 nm is not preferable since the visibility and the readability of the recorded images using reflected light deteriorate. Laser light having the wavelength longer than 1,500 nm is not preferable either since the light absorption and photo-thermal conversion layer is gradually destroyed due to a greater amount of energy per unit pulse and a greater effect of heat and the durability in repeated recording and erasure deteriorates. In practical applications, semiconductor laser light (830 nm) or YAG laser light (1,064 nm) can be advantageously used.

The amount of energy per unit area of the laser light applied by the irradiation for the recording in accordance with the method of the present invention is in the range of 5.0 to 15.0 $mJ/mm^2$ and preferably in the range of 6.0 to 14.0 $mJ/mm^2$.

It is necessary that the amount of energy applied by the irradiation in the method of the present invention be decided in relation to the absorptivity of the near infrared laser light used for the recording of images into the rewritable thermal label in accordance with the method of the present invention with the surface of the label. It is necessary that the product of the amount of energy of irradiation of the laser light and the absorptivity of the laser light during the recording be selected in the range of 3.0 to 14.0 $mJ/mm^2$ and preferably in the range of 3.5 to 12.0 $mJ/mm^2$. When the product of the amount of energy of irradiation of the laser light and the absorptivity of the laser light is smaller than 3.0 $mJ/mm^2$, the amount of energy is insufficient for the recording and the sufficient concentration of the developed color cannot be obtained. When the product of the amount of energy of irradiation of the laser light and the absorptivity of the laser light exceeds 14.0 $mJ/mm^2$, the amount of energy is greater than the amount of energy necessary for the color development. The leuco dye and the long chain alkyl-based color developing agent which have been melted together and developed the color are annealed at temperatures around the temperature of crystallization and are crystallized separately. Thus, the concentration of the developed color decreases or the fracture of the surface takes place.

It is preferable that the distance between the surface of the rewritable thermal label and the light source of the laser light is 30 cm or shorter although the preferable distance is different depending on the output of the irradiation. The shorter the distance, the more preferable from the standpoint of the output of the laser light and the scanning. It is preferable that the laser light is focused to an area having a diameter in the range of about 1 to 300 μm at the surface of the rewritable thermal label from the standpoint of the formation of the image. The greater the speed of scanning, the more advantageous due to the decrease in the recording time. A speed of scanning of 3 m/second or greater is preferable. It is sufficient that the output of the laser is 50 mW or greater. In practical applications, an output in the range of 300 to 10,000 mW is preferable so that the speed of recording is increased.

Excellent images can be obtained when the formed images are quenched by blowing with the cool air or by the like method after the irradiation with the laser light for the recording. For the cooling operation, the scanning with the laser light and the cooling with the air may be conducted alternately or simultaneously.

The erasure in the first embodiment of the method of the present invention is conducted for rewriting the information on the rewritable thermal label into a novel information. For the erasure, the surface of the rewritable thermal label is irradiated with near infrared laser light having a wavelength in the range of 700 to 1,500 nm. The light absorption and photo-thermal conversion layer 3 at the surface of the rewritable thermal label absorbs the light and generates heat and the amount of thermal energy necessary for the erasure can be provided. It is necessary that the amount of energy per unit area provided by the irradiation to the surface of the rewritable thermal label of the non-contact type 10 for the erasure be selected in the range of 1.1 to 3.0 times and preferably in the range of 1.12 to 2.5 times as great as the amount of energy of the laser light per unit area provided by the irradiation for the recording. When the amount of energy for the erasure is smaller than 1.1 times as great as that for the recording, the amount of energy is insufficient for the erasure and it is not possible that the residual image is substantially completely erased. The residual image is slightly left remaining and a decrease in the visibility and deterioration in the readability of bar codes arise as the result of the repeated recording and erasure. When the amount of energy for the erasure exceeds 3.0 times as great as that for the recording, the amount of energy exceeds the amount necessary for the erasure. The light absorption and photo-thermal conversion layer 3 at the surface of the label is destroyed by the laser light and a decrease in the visibility and deterioration in the property for repeated recording arise due to the change in the optical properties. The amount of the residual image can be further decreased by further decreasing the rate of cooling by contacting with a heated roll or by blowing the heated air in combination with the irradiation with the laser light in a prescribed amount of energy. It is preferable that the temperature of the heated roll or the heated air is in the range of 100 to 140° C. The amount of the residual image can be still further decreased by starting the heating within 4 seconds after the irradiation with light for the erasure is started.

As the heated roll, any conventional heated roll can be used without restrictions as long as the surface of the label is heated at 100 to 140° C. within 4 seconds after the irradiation with light for the erasure is started and the surface of the label is not damaged. For example, rubber rolls and stainless steel rolls can be used and silicone rubber rolls exhibiting excellent heat resistance is preferable.

It is preferable that the rubber has a hardness of 40 or greater. When the hardness of the rubber is smaller than 40 and the roll is soft, the adhesive force to the light absorption and photo-thermal conversion layer increases and problems such as attachment of the light absorption and photo-thermal conversion layer to the rubber roll arise.

In the first embodiment of the method of the present invention, when the recording is conducted after the images have been erased, the recording is conducted in the same manner as that for the former recording. In this embodiment, the rewriting can be achieved by irradiation with the laser light in the non-contacting condition even when the rewritable thermal label remains attached to the adherend.

The second embodiment of the method of the present invention will be described in the following.

The second embodiment is the same as the first embodiment of the method of the present invention except that the method for the erasure is different. In the second embodiment, the light used for the irradiation of the surface of the rewritable thermal label for the erasure is ultraviolet light or near infrared light. As the light used for the erasure, ultraviolet light having a wavelength in the range of 200 to 400 nm or near infrared light having a wavelength in the range of 700 to 1,500 nm can be used. Light satisfying the condition that the product of the amount of energy provided by irradiation of the ultraviolet light or the near infrared light and the absorptivity of the ultraviolet light or the near infrared light during the erasure is 1.1 to 3.0 times as great as the product of the amount of energy of irradiation of the laser light and the absorptivity of the laser light with the surface of the label during the recording can be used.

To summarize the advantages obtained by the invention, in accordance with the method of recording and erasure of images using the rewritable thermal label of the non-contact type of the present invention, the recorded images can be substantially completely erased and the rewritable thermal label can be reused without detaching the label from the adherend. Therefore, labor and time required for detaching the label can be eliminated. The method can contribute to the material saving since the label can be recycled together with the adherend after the final use of the label and the adherend.

The rewritable thermal label of the non-contact type used in the present invention can be advantageously used as labels for control of articles such as labels attached to plastic containers used for transporting foods, labels used for control of electronic parts and labels attached to cardboard boxes for control of distribution of articles.

EXAMPLES

The present invention will be described more specifically with reference to examples in the following. However, the present invention is not limited to the examples.

A) Preparation of a Coating Fluid for the Heat-Sensitive Color Development Layer A triarylmethane-based compound which was 3-(4-diethylamino-2-ethoxyphenyl)-3-(1-ethyl-2-methylindol-3-yl)-4-azaphthalide as the dye precursor in an amount of 10 parts by weight, 30 parts by weight of 4-(N-methyl-N-octadecylsulfonylamino)phenol as the reversible color developing agent, 1.5 parts by weight of polyvinyl acetal as the dispersant and 2,500 parts by weight of tetrahydrofuran as the diluting solvent were pulverized by a pulverizer and a dispersion machine to form a dispersion and a coating fluid for forming a heat-sensitive color development layer (Fluid A) was prepared.

B) Preparation of a Coating Fluid for the Light Absorption and Photo-Thermal Conversion Layer A near infrared light absorption and photo-thermal conversion agent (a nickel complex-based coloring matter) [manufactured by TOSCO Co., Ltd.; the trade name: "SDA-5131"] in an amount of 0.3, 0.8, 1, 3 or 5 parts by weight as prescribed for Examples and Comparative Examples, 100 parts by weight of a binder of the ultraviolet light curing type (a urethane acrylate-based binder) [manufactured by DAINICHISEIKA COLOR & CHEMICALS MFG. Co., Ltd.; the trade name: "PU-5 (NS)"] and 3 parts by weight of an inorganic pigment (silica) [manufactured by NIPPON AEROSIL KOGYO Co., Ltd.; the trade name: "AEROSIL R-972"] were dispersed by a dispersion machine and a coating fluid for forming a light absorption and photo-thermal conversion layer (Fluid B) was prepared.

C) Preparation of an Adhesive Layer Having a Release Sheet

A polyethylene terephthalate film having a thickness of 100 μm [manufactured by TORAY Co., Ltd.; the trade name: "LUMILAR T-60"] was coated with a silicone resin containing a catalyst [manufactured by TORAY-DOW CORNING Co., Ltd.; the trade name: "SRX-211"] in an amount such that a layer having a thickness of 0.7 μm was formed after being dried and a release sheet was prepared. The face of the release sheet which was coated with the silicone resin was coated with an adhesive coating fluid prepared by adding 3 parts by weight of a crosslinking agent [manufactured by NIPPON POLYURETHANE Co., Ltd.; the trade name: "CORONATE L"] to 100 parts by weight of an acrylic adhesive [manufactured by TOYO INK SEIZO Co., Ltd.; the trade name: "ORIBINE BPS-1109"] in accordance with the process using a roll knife coater in an amount such that a layer having a thickness of 30 μm was formed after being dried. The formed film coated with the adhesive was dried in an oven at 100° C. for 2 minutes and an adhesive layer having the release sheet was prepared.

D) Method of the Recording (Printing)

The recording was conducted using a laser marker emitting laser light [manufactured by SUNX Co., Ltd.; LP-F10] which used a YAG laser (the wavelength: 1064 nm). The conditions were adjusted as follows: the distance of irradiation: 180 mm; the speed of scanning: 3,000 mm/second; the line width: 0.1 mm; the duty (the fraction of the actual output due to the adjustment by the pulse frequency): 70%; and the spot diameter: 100 μm. The amount of energy provided to the label for the recording was adjusted by changing the output of laser. This value was converted into the amount of energy per unit area (mJ/mm$^2$) and the product of the amount of energy provided by the irradiation and the absorptivity of the near infrared laser used for the recording with the surface of the label was used as the amount of energy used for the recording.

E) Method of the Erasure

The erasure was conducted using a laser marker emitting laser light [manufactured by SUNX Co., Ltd.; LP-F10] which used a YAG laser (the wavelength: 1064 nm). The conditions were adjusted as follows: the distance of irradiation: 100 mm; the speed of scanning: 3,000 mm/second; the line width: 0.1 mm; the duty: 50%; and the spot diameter: 100 μm. The amount of energy provided to the label for the erasure was adjusted by changing the output of laser. This values was converted into the amount of energy per unit area (mJ/mm$^2$). When ultraviolet UV) light was used for the erasure, the value was converted also into the amount of energy per unit area (mJ/mm$^2$). The product of the amount of energy provided by the irradiation and the absorptivity of the near infrared laser light or the ultraviolet light used for the erasure with the surface of the label was used as the amount of energy used for the erasure.

F) Method for the Measurement of the Absorptivity of Light With the Surface of the Label Using a meter for measuring the reflectivity of incident light [manufactured by SHIMADZU SEISAKUSHO Co., Ltd.; "MPC-3100"], the reflectivity of the near infrared laser light and the ultraviolet light incident on the surface of a rewritable thermal label was measured and the value of (100-reflectivity) % was used as the absorptivity of light with the surface.

G) Method for Evaluating the Result

A bar code was printed in a manner such that accurate distinction could be made. The results of the recording and the erasure were evaluated by visual observation and by the use of a bar code reader in accordance with the following criteria having 4 grades:

Result of Recording (Printing)

4: Very clear line charts; line charts could be accurately distinguished by the visual observation and by the use of the bar code reader.

3: Line charts could be distinguished almost well by the visual observation and by the use of the bar code reader.

2: Distinguishing line charts by the visual observation was difficult; the bar code reader frequently made mistakes.

1: Distinguishing line charts was possible neither by the visual observation nor by the use of the bar code reader.

Result of Erasure

4: No residual images of line charts at all; distinguishing residual images of line charts was possible neither by the visual observation nor by the use of the bar code reader.

3: Distinguishing residual images of line charts by the visual observation or by the use of the bar code reader was difficult.

2: Residual images of line charts could be distinguished by the visual observation; the bar code reader frequently made mistakes.

1: Residual images of line charts could be clearly distinguished by the visual observation and by the use of the bar code reader.

Example 1

Fluid A prepared in A) Preparation of a coating fluid for the heat-sensitive color development layer was applied to a foamed film of polyethylene terephthalate having a thickness of 100 μm [manufactured by TOYO BOSEKI Co., Ltd.; the trade name: "CRISPAR K2424"] used as the substrate in accordance with the gravure printing process in an amount such that the formed coating layer had a thickness of 4 μm after being dried. The obtained coating layer was dried in an oven at 60° C. for 5 minutes and a heat-sensitive color development layer was formed. To the obtained heat-sensitive color development layer, Fluid B prepared in B) Preparation of a coating fluid for the light absorption and photo-thermal conversion layer which contained 1 part by weight of the light absorption and photo-thermal conversion agent for near infrared light was applied in accordance with the flexo printing process in an amount such that the formed coating layer had a thickness of 1.2 μm after being dried and the obtained coating layer was irradiated with ultraviolet light. Thus, a light absorption and photo-thermal conversion layer was prepared and a substrate for a rewritable thermal label was obtained.

The adhesive layer having a release sheet prepared in C) Preparation of an adhesive layer having a release sheet was laminated to the back face of the substrate for a rewritable thermal label obtained above. The obtained laminate was wound and a material sheet for the rewritable thermal label was obtained. Then, the obtained material sheet was slit into rolls having a width of 100 mm by a slitter. Rewritable thermal labels having a size of 100 mm×100 mm were prepared from the obtained rolls and used as the samples for recording.

The absorptivity of the near infrared laser light having a wavelength of 1,064 nm with the surface of the rewritable thermal label was measured in accordance with F) Method for the measurement of the absorptivity of light with the surface of the label and was found to be 52%.

The test of the recording was conducted in accordance with D) Method of the recording (printing). The amount of energy of laser light provided to the label for the recording was adjusted at 10 mJ/mm$^2$. Since the absorptivity of the near infrared laser light was 52%, the amount of energy used for the recording was 5.2 mJ/mm$^2$.

The test of the erasure was conducted in accordance with E) Method of the erasure. The amount of energy of laser light provided to the label for the erasure was adjusted at 15 mJ/mm$^2$. The amount of energy used for the erasure was 7.8 mJ/mm$^2$. The amount of energy of laser light provided to the label for the erasure was 1.5 times as great as that for the recording. The air heated at 100° C. was blown for 2 seconds to the face of the label 1 second after the irradiation with the laser light for the erasure.

The results of the evaluation in accordance with G) Method for evaluating the result are shown in Table 1 together with the results of Examples 2 to 11.

TABLE 1-1

| | Example | | | | | |
|---|---|---|---|---|---|---|
| | 1 | 2 | 3 | 4 | 5 | 6 |
| Recording | | | | | | |
| amount of provided energy (a) | 10 | 10 | 15 | 5 | 5 | 10 |
| absorptivity of light % (b) | 52 | 52 | 52 | 71 | 71 | 71 |
| amount of energy used for recording (a × b) | 5.2 | 5.2 | 7.8 | 3.55 | 3.55 | 7.1 |
| result of recording | 4 | 4 | 4 | 3 | 3 | 4 |
| Erasure | | | | | | |
| amount of provided energy (c) | 15 | 15 | 20 | 10 | 10 | 15 |
| absorptivity of light % (d) | 52 | 52 | 52 | 71 | 71 | 71 |
| amount of energy used for erasure (c × d) | 7.8 | 7.8 | 10.4 | 7.1 | 7.1 | 10.65 |
| (c × d)/(a × b) | 1.5 | 1.5 | 1.33 | 2.0 | 2.0 | 1.5 |
| result of erasure | — | 3 | — | — | 3 | — |
| Blowing with heated air | | | | | | |
| time of starting blowing heated air after start of irradiation of light for erasure (second) | 1 | — | 3 | 1 | — | 3 |
| result of erasure | 4 | — | 4 | 4 | — | 4 |

| | Example | | | | |
|---|---|---|---|---|---|
| | 7 | 8 | 9 | 10 | 11 |
| Recording | | | | | |
| amount of provided energy (a) | 15 | 5 | 10 | 5 | 15 |
| absorptivity of light % (b) | 71 | 80 | 80 | 80 | 80 |
| amount of energy used for recording (a × b) | 10.65 | 4.0 | 8.0 | 4.0 | 12.0 |
| result of recording | 4 | 3 | 4 | 3 | 4 |
| Erasure | | | | | |
| amount of provided energy (c) | 20 | 10 | 15 | UV 10 | UV 15 |
| absorptivity of light % (d) | 71 | 80 | 80 | UV 90 | UV 90 |
| amount of energy used for erasure (c × d) | 14.2 | 8.0 | 12.0 | 9.0 | 13.5 |
| (c × d)/(a × b) | 1.33 | 2.0 | 1.5 | 2.25 | 1.13 |
| result of erasure | — | — | — | 4 | 4 |

TABLE 1-1-continued

| | | | | | |
|---|---|---|---|---|---|
| Blowing with heated air | | | | | |
| time of starting blowing heated air after start of irradiation of light for erasure (second) | 3 | 1 | 1 | — | — |
| result of erasure | 4 | 4 | 4 | — | — |

Note:
The unit of amount of energy: mJ/mm$^2$

Example 2

The same procedures as those conducted in Example 1 were conducted except that the blowing with the air heat at 100° C. was not conducted during the erasure.

Example 3

The same procedures as those conducted in Example 1 were conducted except that the energies provided to the label for the recording and the erasure and the condition of blowing with the air heated at 100° C. were changed.

The amount of energy of laser light provided to the label for the recording was adjusted at 15 mJ/mm$^2$.

Since the absorptivity of the near infrared laser light was 52%, the amount of energy used for the recording was 7.8 mJ/mm$^2$. The amount of energy of laser light provided to the label for the erasure was adjusted at 20 mJ/mm$^2$. The amount of energy used for the erasure was 10.4 mJ/mm$^2$. The amount of energy of laser light provided to the label for the erasure was 1.33 times as great as that for the recording. The air heated at 100° C. was blown for 2 seconds to the face of the label 3 seconds after the irradiation with the laser light for the erasure.

Example 4

The same procedures as those conducted in Example 1 were conducted except that the light absorption and photo-thermal conversion layer was prepared using 3 parts by weight of the light absorption and photo-thermal conversion agent described in B) and the energies used for the recording and the erasure were changed.

The absorptivity of the near infrared laser light having a wavelength of 1,064 nm with the surface of the rewritable thermal label was 71%. The amount of energy of laser light provided to the label for the recording was adjusted at 5 mJ/mm$^2$. Since the absorptivity of the near infrared laser light was 71%, the amount of energy used for the recording was 3.55 mJ/mm$^2$. The amount of energy of laser light provided to the label for the erasure was 10 mJ/mm$^2$. The amount of energy of laser light used for the erasure was 7.1 mJ/mm$^2$. The amount of energy of laser light provided to the label for the erasure was 2.0 times as great as that for the recording. The air heated at 100° C. was blown for 2 seconds to the face of the label 1 second after the irradiation with the laser light for the erasure.

Example 5

The same procedures as those conducted in Example 4 were conducted except that the blowing with the air heat at 100° C. was not conducted.

Example 6

The same procedures as those conducted in Example 4 were conducted except that the energies used for the recording and the erasure and the condition of blowing with the air heated at 100° C. were changed. The amount of energy of laser light provided to the label for the recording was adjusted at 10 mJ/mm$^2$. Since the absorptivity of the near infrared laser light was 71%, the amount of energy used for the recording was 7.1 mJ/mm$^2$. The amount of energy of laser light provided to the label for the erasure was adjusted at 15 mJ/mm$^2$. The amount of energy used for the erasure was 10.65 mJ/mm$^2$. The amount of energy of laser light provided to the label for the erasure was 1.5 times as great as that for the recording. The air heated at 100° C. was blown for 2 seconds to the face of the label 3 seconds after the irradiation with the laser light for the erasure.

Example 7

The same procedures as those conducted in Example 4 were conducted except that the energies used for the recording and the erasure and the condition of blowing with the air heated at 100° C. were changed. The amount of energy of laser light provided to the label for the recording was adjusted at 15 mJ/mm$^2$. Since the absorptivity of the near infrared laser light was 71%, the amount of energy used for the recording was 10.65 mJ/mm$^2$. The amount of energy of laser light provided to the label for the erasure was adjusted at 20 mJ/mm$^2$. The amount of energy used for the erasure was 14.2 mJ/mm$^2$. The amount of energy of laser light provided to the label for the erasure was 1.33 times as great as that for the recording. The air heated at 100° C. was blown for 2 seconds to the face of the label 3 seconds after the irradiation with the laser light for the erasure.

Example 8

The same procedures as those conducted in Example 1 were conducted except that the light absorption and photo-thermal conversion layer was prepared using 5 parts by weight of the light absorption and photo-thermal conversion agent described in B) and the energies used for the recording and the erasure were changed. The absorptivity of the near infrared laser light having a wavelength of 1,064 nm with the surface of the rewritable thermal label was 80%. The amount of energy of laser light provided to the label for the recording was adjusted at 5 mJ/mm$^2$. Since the absorptivity of the near infrared laser light was 80%, the amount of energy used for the recording was 4.0 mJ/mm$^2$. The amount of energy of laser light provided to the label for the erasure was adjusted at 10 mJ/mm$^2$. The amount of energy used for the erasure was 8.0 mJ/mm$^2$. The amount of energy of laser light provided to the label for the erasure was 2.0 times as great as that for the recording. The air heated at 100° C. was blown for 2 seconds to the face of the label 1 second after the irradiation with the laser light for the erasure.

Example 9

The same procedures as those conducted in Example 8 were conducted except that the energies used for the recording and the erasure were changed. The amount of energy of laser light provided to the label for the recording was adjusted at 10 mJ/mm$^2$. Since the absorptivity of the near infrared laser light was 80%, the amount of energy used for the recording was 8.0 mJ/mm$^2$. The amount of energy of laser light provided to the label for the erasure was adjusted at 15 mJ/mm$^2$. The amount of energy used for the erasure was 12.0 mJ/mm$^2$. The amount of energy of laser light provided to the label for the erasure was 1.5 times as great as that for the recording. The air heated at 100° C. was blown for 2 seconds to the face of the label 1 second after the irradiation with the laser light for the erasure.

Example 10

The same procedures as those conducted in Example 1 were conducted except that the light absorption and photo-thermal conversion layer was prepared using 5 parts by weight of the light absorption and photo-thermal conversion agent described in B), the energies used for the recording and the erasure were changed, ultraviolet light (the main component having a wavelength of 250 nm) was used as the light used for the erasure, and the blowing with the air heated at 100° C. was not conducted. The absorption of the near infrared laser light having a wavelength of 1,064 nm with the surface of the rewritable thermal label was 80%. The absorptivity of the above ultraviolet light with the surface of the rewritable thermal label was 90%. The amount of energy of laser light provided to the label for the recording was adjusted at 5 mJ/mm$^2$. Since the absorptivity of the near infrared laser light was 80%, the amount of energy used for the recording was 4.0 mJ/mm$^2$. The amount of energy of ultraviolet light obtained by using an ultraviolet fusion H bulb and provided to the label for the erasure was adjusted at 10 mJ/mm$^2$. Since the absorptivity of the ultraviolet light was 90%, the amount of energy used for the erasure was 9.0 mJ/mm$^2$. The amount of energy of laser light provided to the label for the erasure was 2.25 times as great as that for the recording.

Example 11

The same procedures as those conducted in Example 10 were conducted except that the energies used for the recording and the erasure were changed. The amount of energy of laser light provided to the label for the recording was adjusted at 15 mJ/mm$^2$. Since the absorptivity of the near infrared laser light was 80%, the amount of energy used for the recording was 12.0 mJ/mm$^2$. Since the amount of energy of ultraviolet light obtained by using the ultraviolet light fusion H bulb and provided to the label for the erasure was adjusted at 15 mJ/mm$^2$, the amount of energy used for the erasure was 13.5 mJ/mm$^2$. The amount of energy of laser light provided to the label for the erasure was 1.13 times as great as that for the recording.

Comparative Example 1

The same procedures as those conducted in Example 1 were conducted except that the light absorption and photo-thermal conversion layer was prepared using 0.8 parts by weight of the light absorption and photo-thermal conversion agent described in B), the energies used for the recording and the erasure were changed, and the condition of blowing with the air heated at 100° C. was changed. The absorptivity of the near infrared laser light having a wavelength of 1,064 nm with the surface of the rewritable thermal label was 45%. The amount of energy of laser light provided to the label for the recording was adjusted at 5 mJ/mm$^2$. Since the absorptivity of the near infrared laser light was 45%, the amount of energy used for the recording was 2.25 mJ/mm$^2$. The amount of energy of laser light provided to the label for the erasure was adjusted at 5 mJ/mm$^2$. The amount of energy used for the erasure was 2.25 mJ/mm$^2$. The amount of energy of laser light provided to the label for the erasure was 1.0 times as great as that for the recording. The air heated at 100° C. was blown for 2 seconds to the face of the label 5 seconds after the irradiation with the laser light for the erasure.

The results of the evaluation in accordance with G) Method for evaluating the result are shown in Table 2 together with the results of Comparative Examples 2 to 8.

TABLE 2

| | Comparative Example | | | | | | | |
|---|---|---|---|---|---|---|---|---|
| | 1 | 2 | 3 | 4 | 5 | 6 | 7 | 8 |
| Recording | | | | | | | | |
| amount of provided energy (e) | 5 | 5 | 15 | 2 | 5 | 2 | 20 | 5 |
| absorptivity of light % (f) | 45 | 45 | 33 | 52 | 52 | 71 | 80 | 80 |
| amount of energy used for recording (e × f) | 2.25 | 2.25 | 4.95 | 1.04 | 2.60 | 1.42 | 16.0 | 4.0 |
| result of recording | 2 | 2 | 1 | 2 | 2 | 2 | 1 | 2 |
| Erasure | | | | | | | | |
| amount of provided energy (g) | 5 | 5 | 10 | 5 | 5 | 30 | 30 | UV 3 |
| absorptivity of light % (h) | 45 | 45 | 33 | 52 | 52 | 71 | 80 | UV 90 |
| amount of energy used for erasure (g × h) | 2.25 | 2.25 | 3.30 | 2.60 | 2.60 | 21.3 | 24 | 2.70 |
| (g × h)/(e × f) | 1.0 | 1.0 | 0.67 | 2.5 | 1.0 | 15.0 | 1.5 | 0.68 |
| result of erasure | — | 1 | — | — | — | — | — | 2 |
| Blowing with heated air | | | | | | | | |
| time of starting blowing heated air after start of irradiation of light for erasure (second) | 5 | — | 5 | 5 | 5 | 3 | 3 | — |
| result of erasure | 2 | — | 2 | 2 | 2 | 1 | 1 | — |

Note:
The unit of amount of energy: mJ/mm$^2$

Comparative Example 2

The same procedures as those conducted in Comparative Example 1 were conducted except that the blowing with the air heat at 100° C. was not conducted during the erasure.

Comparative Example 3

The same procedures as those conducted in Example 1 were conducted except that the light absorption and photo-thermal conversion layer was prepared using 0.3 parts by weight of the light absorption and photo-thermal conversion agent described in B), the energies used for the recording and the erasure were changed, and the condition of blowing with the air heated at 100° C. was changed. The absorptivity of the near infrared laser light having a wavelength of 1,064 nm with the surface of the rewritable thermal label was 33%. The amount of energy of laser light provided to the label for the recording was adjusted at 15 mJ/mm$^2$. Since the absorptivity of the near infrared laser light was 33%, the amount of energy used for the recording was 4.95 mJ/mm$^2$. The amount of energy of laser light provided to the label for the erasure was adjusted at 10 mJ/mm$^2$. The amount of energy used for the erasure was 3.30 mJ/mm$^2$. The amount of energy of laser light provided to the label for the erasure was 0.67 times as great as that for the recording. The air heated at 100° C. was blown for 2 seconds to the face of the label 5 seconds after the irradiation with the laser light for the erasure.

Comparative Example 4

The same procedures as those conducted in Example 1 were conducted except that the energies used for the recording and the erasure and the condition of blowing with the air heated at 100° C. were changed. The absorptivity of the laser light having the wavelength of 1,064 nm with the surface of the rewritable thermal label was 52%. The amount of energy of laser light provided to the label for the recording was adjusted at 2 mJ/mm$^2$. Since the absorptivity of the near infrared laser light was 52%, the amount of energy used for the recording was 1.04 mJ/mm$^2$. The amount of energy of laser light provided to the label for the erasure was adjusted at 5 mJ/mm$^2$. The amount of energy used for the erasure was 2.60 mJ/mm$^2$. The amount of energy of laser light provided to the label for the erasure was 2.5 times as great as that for the recording. The air heated at 100° C. was blown for 2 seconds to the face of the label 5 seconds after the irradiation with the laser light for the erasure.

Comparative Example 5

The same procedures as those conducted in Example 1 were conducted except that the energies used for the recording and the erasure and the condition of blowing with the air heated at 100° C. were changed. The absorptivity of the laser light having the wavelength of 1,064 nm with the surface of the rewritable thermal label was 52%. The amount of energy of laser light provided to the label for the recording was adjusted at 5 mJ/mm$^2$. Since the absorptivity of the near infrared laser light was 52%, the amount of energy used for the recording was 2.60 mJ/mm$^2$. The amount of energy of laser light provided to the label for the erasure was adjusted at 5 mJ/mm$^2$. The amount of energy used for the erasure was 2.60 mJ/mm$^2$. The amount of energy of laser light provided to the label for the erasure was 1.0 times as great as that for the recording. The air heated at 100° C. was blown for 2 seconds to the face of the label 5 seconds after the irradiation with the laser light for the erasure.

Comparative Example 6

The same procedures as those conducted in Example 1 were conducted except that the light absorption and photo-thermal conversion layer was prepared using 3 parts by weight of the light absorption and photo-thermal conversion agent described in B), the energies used for the recording and the erasure were changed, and the condition of blowing with the air heated at 100° C. was changed. The absorptivity of the near infrared laser light having a wavelength of 1,064 nm with the surface of the rewritable thermal label was 71%. The amount of energy of laser light provided to the label for the recording was adjusted at 2 mJ/mm$^2$. Since the absorptivity of the near infrared laser light was 71%, the amount of energy used for the recording was 1.42 mJ/mm$^2$. The amount of energy of laser light provided to the label for the erasure was adjusted at 30 mJ/mm$^2$. The amount of energy used for the erasure was 21.3 mJ/mm$^2$. The amount of energy of laser light provided to the label for the erasure was 15.0 times as great as that for the recording. The air heated at 100° C. was blown for 2 seconds to the face of the label 3 seconds after the irradiation with the laser light for the erasure. The surface of the label was destroyed by irradiation with the excessive amount of the laser light during the erasure.

Comparative Example 7

The same procedures as those conducted in Example 1 were conducted except that the light absorption and photo-thermal conversion layer was prepared using 5 parts by weight of the light absorption and photo-thermal conversion agent described in B), and the amounts of energies used for the recording and the erasure and the condition of blowing with the air heated at 100° C. were changed. The absorptivity of the near infrared laser light having a wavelength of 1,064 nm with the surface of the rewritable thermal label was 80%. The amount of energy of laser light provided to the label for the recording was adjusted at 20 mJ/mm$^2$. Since the absorptivity of the near infrared laser light was 80%, the amount of energy used for the recording was 16 mJ/mm$^2$. The amount of energy of laser light provided to the label for the erasure was adjusted at 30 mJ/mm$^2$. The amount of energy used for the erasure was 24 mJ/mm$^2$. The amount of energy of laser light provided to the label for the erasure was 1.5 times as great as that for the recording. The air heated at 100° C. was blown for 2 seconds to the face of the label 3 seconds after the irradiation with the laser light for the erasure. The surface of the label was destroyed by irradiation with the excessive amount of the laser light during the recording and the erasure.

Comparative Example 8

The same procedures as those conducted in Example 10 were conducted except that the light absorption and photo-thermal conversion layer was prepared using 5 parts by weight of the light absorption and photo-thermal conversion agent described in B), the energies used for the recording and the erasure were changed, ultraviolet light (the main component having a wavelength of 250 nm) was used for the erasure, and the blowing with the air heated at 100° C. was not conducted. The absorptivity of the near infrared laser light having a wavelength of 1,064 nm with the surface of the rewritable thermal label was 80%. The amount of energy of laser light provided to the label for the recording was adjusted at 5 mJ/mm$^2$. Since the absorptivity of the near infrared laser light was 80%, the amount of energy used for the recording was 4.0 mJ/mm$^2$. The amount of energy of ultraviolet light provided to the label for the erasure was adjusted at 3 mJ/mm$^2$. Since the absorptivity of the ultraviolet light with the surface of the label was 90%, the amount of energy of ultraviolet light used for the erasure was 2.70 mJ/mm$^2$. The amount of energy of laser light provided to the label for the erasure was 0.68 times as great as that for the recording.

What is claimed is:

1. A method for recording and erasure of images using rewritable thermal label of a non-contact type which comprises a heat-sensitive color development layer comprising a leuco dye and a long chain alkyl-based color developing agent and a light absorption and photo-thermal conversion layer which are laminated on one face of a substrate successively, the heat-sensitive color development layer being placed next to the substrate, and an adhesive layer laminated on an other face of the substrate, wherein an absorptivity of laser light used for the recording with a surface of the label is 50% or greater, the laser light irradiating the surface of the label for the recording has a wavelength in a range of 700 to 1,500 nm and an amount of energy of irradiation in a range of 5.0 to 15.0 mJ/mm$^2$, a product of the amount of energy of irradiation of the laser light and the absorptivity of the laser light during the recording is in a range of 3.0 to 14.0 mJ/mm$^2$, and a product of an amount of energy of irradiation of the laser light and an absorptivity of the laser light with the surface of the label during the erasure is 1.1 to 3.0 times as great as the product of the amount of energy of irradiation of the laser light and the absorptivity of the laser light during the recording.

2. A method according to claim 1, wherein, during the erasure of images, the surface of the label is heated within 4 seconds after irradiation with the laser light for the erasure is started.

3. A method according to claim 2, wherein the absorptivity of light with the surface of the label is in a range of 50 to 90% and the method is used for recording images into labels in which the recorded images are read using reflected light.

4. A method according to claim 1, wherein the absorptivity of light with the surface of the label is in a range of 50 to 90% and the method is used for recording images into labels in which the recorded images are read using reflected light.

5. A method for recording and erasure of images using rewritable thermal label of a non-contact type which comprises a heat-sensitive color development layer comprising a leuco dye and a long chain alkyl-based color developing agent and a light absorption and photo-thermal conversion layer which are laminated on one face of a substrate successively, the heat-sensitive color development layer being placed next to the substrate, and an adhesive layer laminated on an other face of the substrate, wherein an absorptivity of laser light used for the recording with a surface of the label is 50% or greater, the laser light irradiating the surface of the label for the recording has a wavelength in a range of 700 to 1,500 nm and an amount of energy of irradiation in a range of 5.0 to 15.0 mJ/mm$^2$, a product of the amount of energy of irradiation of the laser light and the absorptivity of the laser light during the recording is in a range of 3.0 to 14.0 mJ/mm$^2$, a light irradiating the surface of the label for the erasure is ultraviolet light or near infrared light, and a product of an amount of energy of irradiation of the ultraviolet light or the near infrared light and an absorptivity of the ultraviolet light or the near infrared light with the surface of the label during the erasure is 1.1 to 3.0 times as great as the product of the amount of energy of irradiation of the laser light and the absorptivity of the laser light during the recording.

6. A method according to claim 5, wherein the light irradiating the surface of the label for the erasure is ultraviolet light having a wavelength in a range of 200 to 400 nm or near infrared light having a wavelength in a range of 700 to 1,500 nm.

7. A method according to claim 6, wherein the absorptivity of light with the surface of the label is in a range of 50 to 90% and the method is used for recording images into labels in which the recorded images are read using reflected light.

8. A method according to claim 5, wherein, during the erasure of images, the surface of the label is heated within 4 seconds after irradiation with the ultraviolet light or the near infrared light for the erasure is started.

9. A method according to claim 8, wherein the absorptivity of light with the surface of the label is in a range of 50 to 90% and the method is used for recording images into labels in which the recorded images are read using reflected light.

10. A method according to claim 6, wherein, during the erasure of images, the surface of the label is heated within 4 seconds after irradiation with the ultraviolet light or the near infrared light for the erasure is started.

11. A method according to claim 10, wherein the absorptivity of light with the surface of the label is in a range of 50 to 90% and the method is used for recording images into labels in which the recorded images are read using reflected light.

12. A method according to claim 5, wherein the absorptivity of light with the surface of the label is in a range of 50 to 90% and the method is used for recording images into labels in which the recorded images are read using reflected light.

* * * * *